US006513268B2

(12) United States Patent
Lee et al.

(10) Patent No.: US 6,513,268 B2
(45) Date of Patent: Feb. 4, 2003

(54) QUICK COUPLER FOR EXCAVATOR

(75) Inventors: Yong Bum Lee, Taejon (KR); Hyoung Eui Kim, Taejon (KR)

(73) Assignee: Korea Institute of Machinery and Materials, Taejon (KR)

( * ) Notice: Subject to any disclaimer, the term of this patent is extended or adjusted under 35 U.S.C. 154(b) by 0 days.

(21) Appl. No.: 10/054,685

(22) Filed: Jan. 22, 2002

(65) Prior Publication Data

US 2002/0170211 A1 Nov. 21, 2002

(30) Foreign Application Priority Data

May 18, 2001 (KR) ..... 01-27305

(51) Int. Cl.[7] ..... E02F 3/40; E02F 3/00

(52) U.S. Cl. ..... 37/468; 37/403; 404/723; 172/273

(58) Field of Search ..... 37/468, 403, 231, 37/409; 414/723; 403/31, 320–325; 172/272, 273, 275

(56) References Cited

U.S. PATENT DOCUMENTS 5,125,788 A * 6/1992 Stenger ..... 414/723
5,802,753 A * 9/1998 Raunisto ..... 37/468
5,865,594 A * 2/1999 Kim ..... 414/723
6,231,296 B1 * 5/2001 Blomgren ..... 414/723
6,241,455 B1 * 6/2001 Schupback et al. ..... 414/723
6,332,747 B1 * 12/2001 Lee ..... 414/723
6,385,872 B1 * 5/2002 Mieger et al. ..... 37/468

* cited by examiner

*Primary Examiner*—Robert E. Pezzuto
*Assistant Examiner*—Thomas A. Beach
(74) *Attorney, Agent, or Firm*—Allen, Dyer, Doppelt, Milbrath & Gilchrist, P.A.

(57) ABSTRACT

A quick coupler for an excavator includes a cylinder tube fixed to each lower end of an excavator arm and a link, and having fixing bolt holes formed on one side thereof; a piston housing fitted into the cylinder tube to be fixed by fixing bolts inserted into the fixing bolt holes, and joined with a rod cover at both ends thereof, respectively; a pair of pistons inserted into each side of the piston housing with a spring interposed therebetween, each piston having a mechanical seal formed at its inner end; the pair of rod covers inserted between an outer circumference of the piston and an inner circumference of the piston housing on each side of the piston housing for preventing leakage of hydraulic fluid; and a pair of coupler pins inserted between an outer circumference of the piston housing and an inner circumference of the cylinder tube on each side of the cylinder tube, each coupler pin formed in a cap-shape.

10 Claims, 7 Drawing Sheets

QUICK COUPLER FOR EXCAVATOR

FIELD OF THE INVENTION

The present invention relates to a quick coupler for an excavator, and more particularly to such a quick coupler, which is provided on each lower end side of an excavator arm and a link in the excavator in such a manner that it facilitates mounting or detaching of an accessory to be exchanged depending on work conditions, such as a bucket, a breaker, a crusher, a vibration hammer or the like.

BACKGROUND OF THE INVENTION

In general, an excavator is an equipment which performs a variety of constructional works, for example, excavating the ground, removing soil or sand, crushing rocks, breaking pavements paved with asphalt or concrete and so forth by a selected accessory (a bucket, a breaker, a crusher, a vibration hammer, etc.) corresponding to work conditions.

Now, an excavator with a bucket mounted thereon will be described in detail for the purpose of illustrating a conventional quick coupler for an excavator.

FIG. 1 is a perspective view of an excavator with a conventional coupler attached thereto, and FIG. 2 is a sectional view of the conventional quick coupler for use in the excavator. Since the quick coupler is bilaterally symmetrical, the following description will be given only for one symmetrical side of the quick coupler.

As shown FIGS. 1 and 2, the excavator has a structure in which a first link 41 cooperates with a second link 42 to drive the bucket 4 in accordance with forward and backward movements of a working cylinder 40.

In such an excavator, the conventional quick coupler for coupling an excavator arm 1 with the bucket 4 is provided between lower ends of the excavator arm 1 and the second link 42, and, as shown in FIG. 2, is so constructed that a piston 30 is expanded and inserted into a pinhole 25*a* of the bucket 4 to couple the excavator arm 1 with the bucket 4 when hydraulic pressure is supplied to an advance pressure chamber 32 through an advance port 28.

In the conventional coupler, however, a piston seal 34 is disposed on an outer circumferential surface of the piston 30, which causes a problem that external contaminants are introduced into an astem pressure chamber 32*a* to adulterate hydraulic working oil therein and thus to shorten the life span of the overall hydraulic system when the piston 30 is dented or abraded. Also, if a load is imposed on any one side piston 30 due to its dent or abrasion, the other side piston 30 bearing no load is moved toward the one with the load imposed, thereby causing the astern pressure chamber 32*a* to be opened outward. Besides, when the piston 30 is directly inserted into the pinhole 25*a,* it may be deformed or damaged due to a fact that it is subjected to a perpendicular axial external force (radial force) between the excavator arm 1 and the bucket 4.

That is, since the piston 30 is not allowed to be flexible in structure, it is easily deformed (for example, bent) or damaged on its surface. As the result, oil leakage may occur, the piston 30 may be not operate well and lose its function. Ultimately, the piston 30 must be replaced early.

The conventional quick coupler has also a problem in that it is difficult to position the pinhole 25*a* and the piston 30 in a centered position when the quick coupler is joined with the bucket 4.

SUMMARY OF THE INVENTION

Accordingly, the present invention has been made to overcome the above-mentioned problems, and it is an object of the present invention to provide a quick coupler for an excavator, which is mounted on each lower end side of an excavator arm and a link of the excavator in such a manner that it facilitates mounting or detaching of an accessory, such as a bucket, a breaker, a crusher, a vibration hammer or the like to be exchanged depending on work conditions.

It is another object of the present invention to provide a quick coupler for an excavator, which is bilaterally symmetrical and always constant in its forward and backward movement lengths without distorting joints of the excavator, and prevents contaminants from being mixed into hydraulic working oil by a triple sealing structure of a mechanical seal, a cover seal and a rod seal.

It is still another object of the present invention to provide a quick coupler for an excavator, which easily and simply allows centering between a joining pinhole of the accessory and a coupler pin by attaching a position guide, and in which the coupler pin having flexibility has no effect on a working piston even when it is subjected to a perpendicular axial external force (radial force).

To accomplish these objects, there is provided a quick coupler for an excavator in accordance with the present invention, the quick coupler comprising: a cylinder tube fixed to each lower end of an excavator arm and a link, and having fixing bolt holes formed on one side thereof; a piston housing fitted into the cylinder tube to be fixed by fixing bolts inserted into the fixing bolt holes, and joined with a rod cover at both ends thereof, respectively; a pair of pistons inserted into each side of the piston housing with a spring interposed therebetween, each piston having a mechanical seal formed at its inner end; the pair of rod covers inserted between an outer circumference of the piston and an inner circumference of the piston housing on each side of the piston housing for preventing leakage of hydraulic fluid; and a pair of coupler pins inserted between an outer circumference of the piston housing and an inner circumference of the cylinder tube on each side of the cylinder tube, each coupler pin formed in a cap-shape.

Preferably, one end of the coupler pin is formed with a predetermined number of axial tightening bolt holes which penetrate a part of a ring groove formed on the coupler pin side, and an inner diameter of a conjugation groove formed on an inner side of the coupler pin is larger than an outer diameter of the piston.

It is also preferred that a cover seal for preventing oil leakage is provided in a contact portion between the rod cover and the piston housing, and a rod seal for preventing oil leakage is similarly provided in a contact portion between the rod cover and the piston.

A pin seal for preventing inflow of contaminants is further provided in an inlet portion of the cylinder tube with which the coupler pin is brought into sliding contact.

Moreover, an advance port is mounted to penetrate the cylinder tube and the piston housing in one position to supply hydraulic pressure to an advance pressure chamber; the piston housing is formed with a longitudinal pressure line that leads into an astern pressure chamber, and an astern port is mounted to penetrate the cylinder tube and the piston housing in another position and connected with the pressure line to supply hydraulic pressure to the astern pressure chamber.

Furthermore, position guides in a semicircular-shape are preferably attached to upper portions of both ends of the excavator arm and a lower end of the link, respectively to allow centering between the joining pinhole and the coupler pin.

BRIEF DESCRIPTION OF THE DRAWINGS

The above and other objects, features and other advantages of the present invention will be more apparent from the following detailed description taken in conjunction with the accompanying drawings, in which.

DESCRIPTION OF THE PREFERRED EMBODIMENTS

Figure 1:
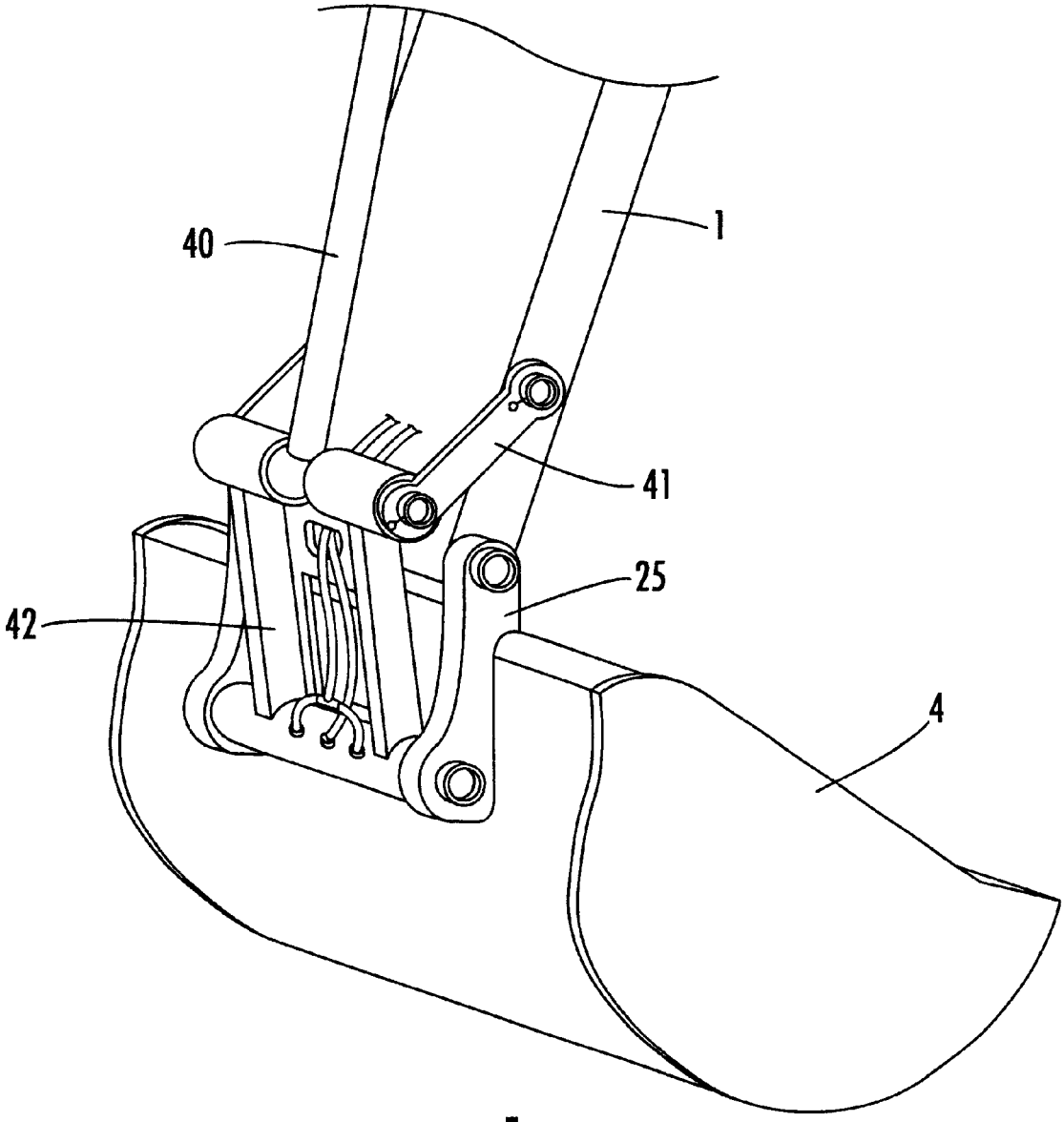
FIG. 1. PRIOR ART
FIG. 1 is a perspective view of a link mechanism in an excavator with a conventional quick coupler attached thereto.
Figure 2:
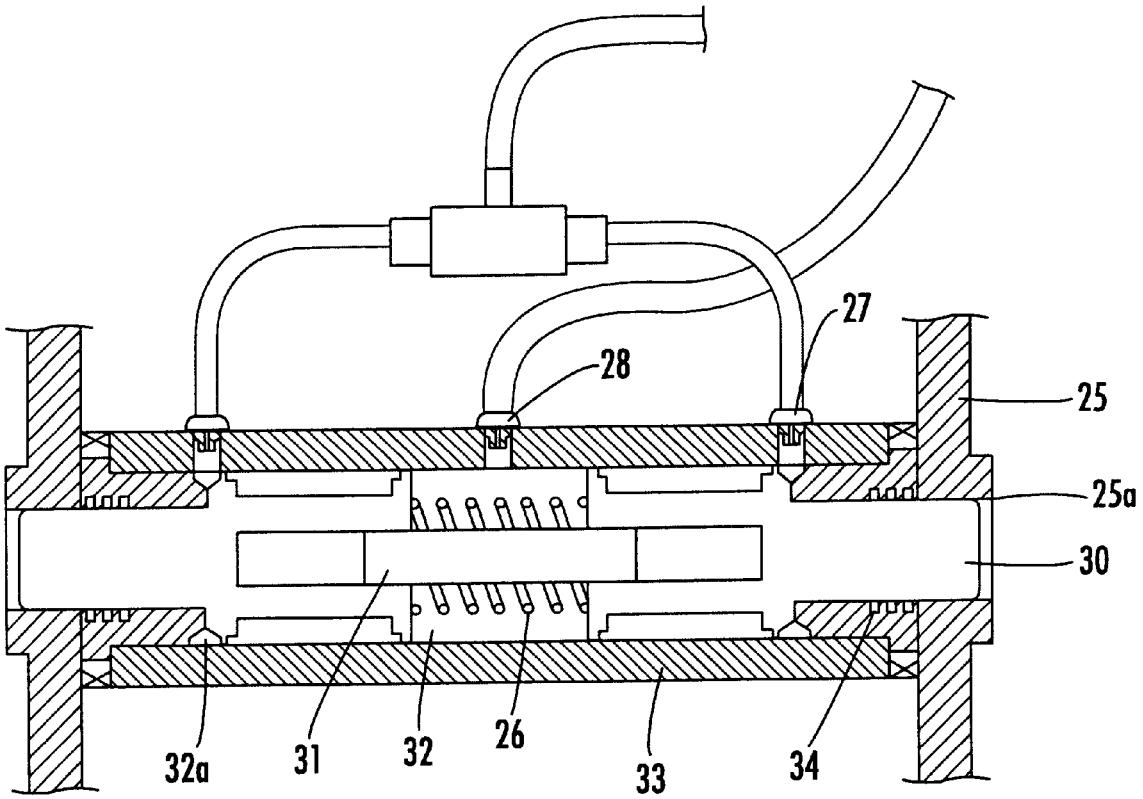
FIG. 2. PRIOR ART
FIG. 2 is a sectional view of the conventional quick coupler for use in the excavator.

Hereinafter, a preferred embodiment of the present invention will be described with reference to the accompanying drawings. In the following description and all drawings, the same reference numerals are used to designate the same or similar components, and so repetition of the description of the same or similar components will be omitted.

A quick coupler for an excavator according to the present invention serves as a pin which is provided on each lower end side of an excavator arm and a link for use in mounting and detaching of an accessory (a bucket, a breaker, a crusher, a vibration hammer, etc.) to be exchanged depending on working conditions.

Figure 3:
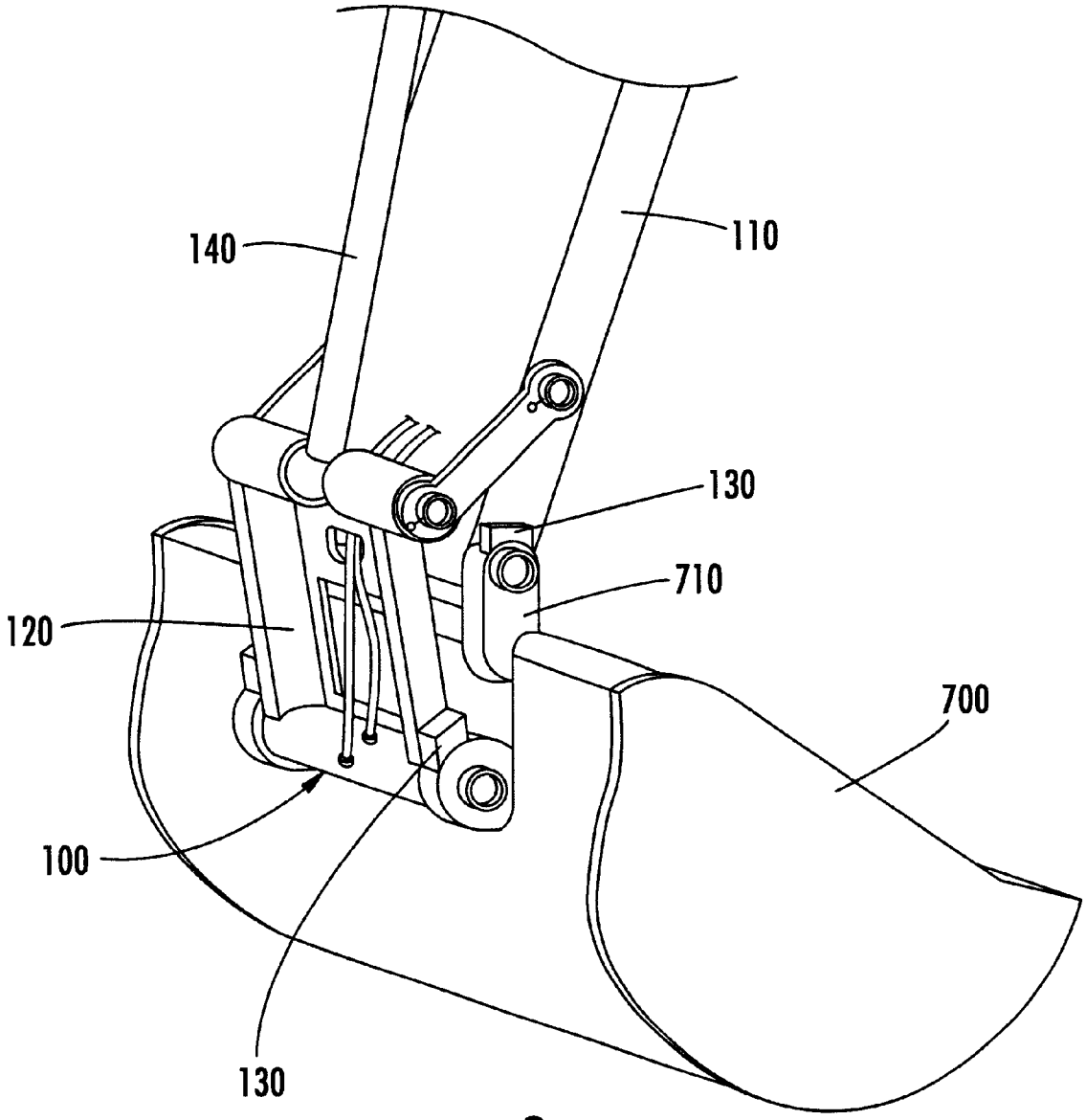
FIG. 3 is a perspective view of an excavator with a quick coupler in accordance with the present invention attached thereto.
Figure 4:
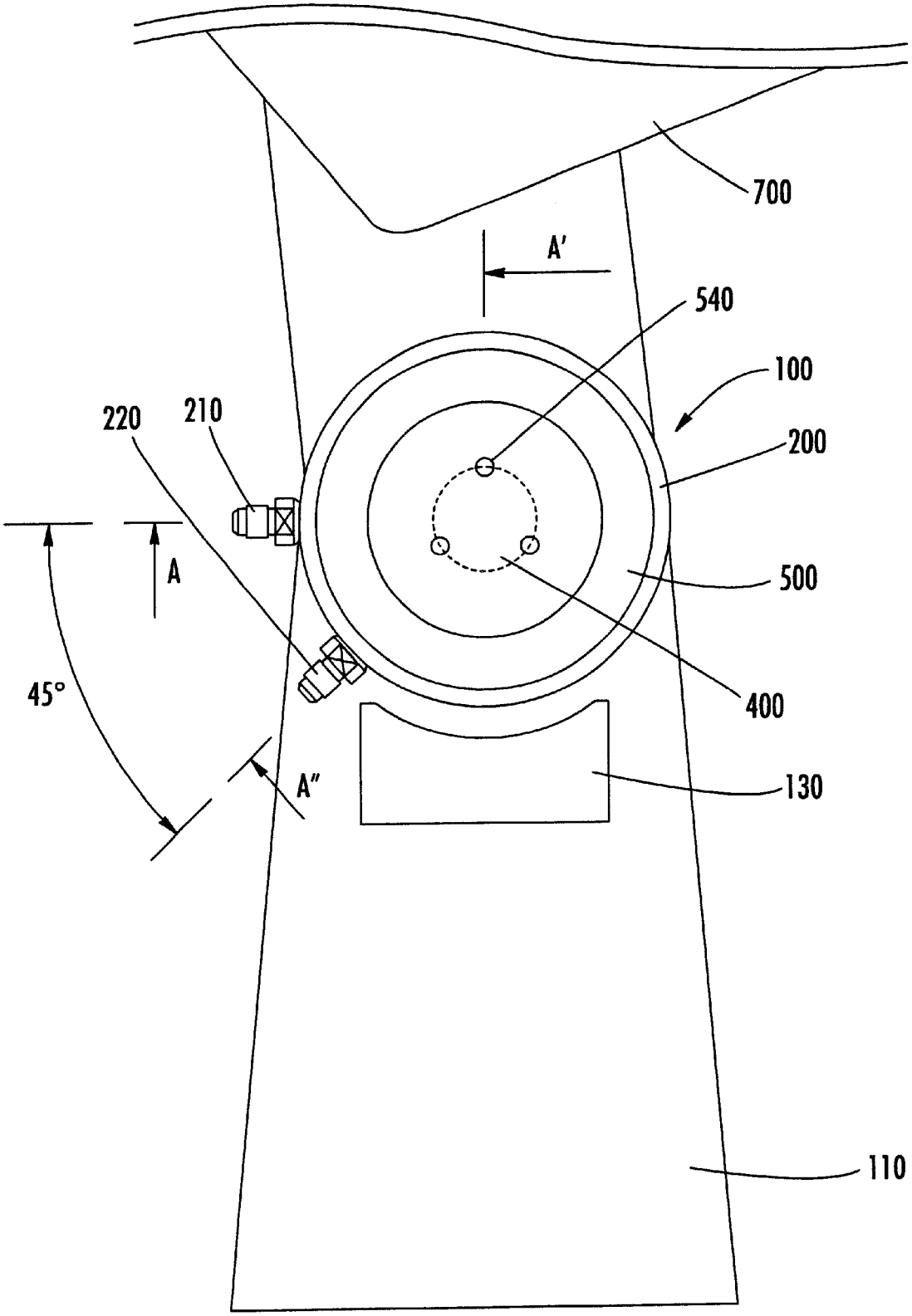
FIG. 4 is a side view of an excavator arm with the quick coupler in accordance with the present invention attached thereto.

FIG. 3 is a perspective view of the excavator with the quick coupler in accordance with the present invention attached thereto, and FIG. 4 is a side view of an excavator arm with the quick coupler in accordance with the present invention attached thereto.

FIGS. 3 and 4 illustrate one embodiment in which a bucket 700 is mounted to the excavator, the bucket 700 being pivotally moved over a certain angle to perform a variety of construction works, for example, removal of soil or sand, excavating the ground or the like. In this case, the bucket 700 employs a four-joint link mechanism as a structure for its pivotal movement, and four joint links constituting the four-joint link mechanism are joined with one another by means of pins so that they can be rotated relative to one another. In particular, the bucket 700 may be exchanged for another accessory (a breaker, a crusher, a vibration hammer, etc.) depending on the working conditions, which is easily and simply achieved by using the quick coupler 100 on each lower end sides of the excavator arm 110 and the link 120.

Figure 5:
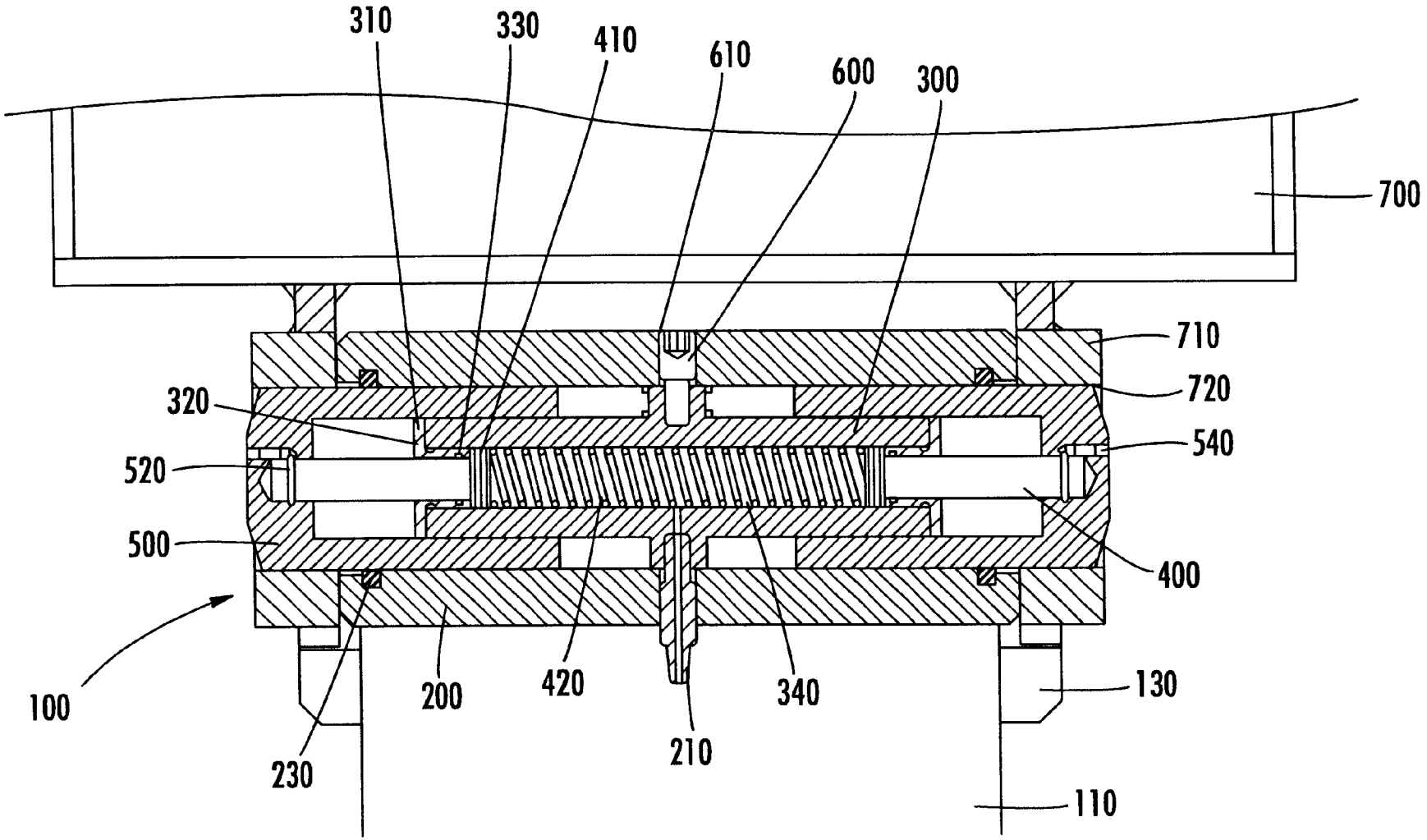
FIG. 5 is a sectional view taken along line A–A' of FIG. 4.
Figure 6:
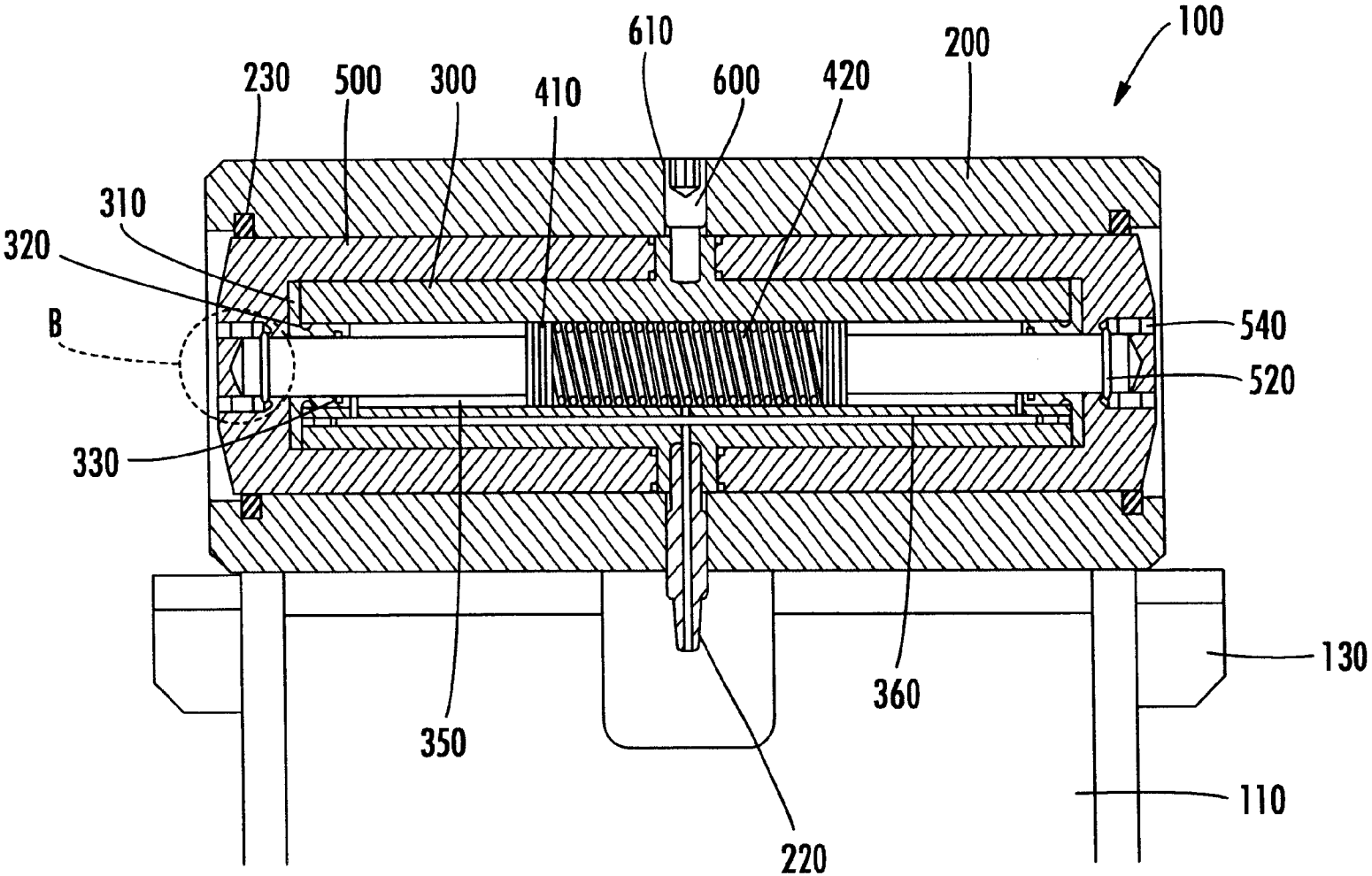
FIG. 6 is a sectional view taken along line A–A" of FIG. 4.

FIGS. 5 and 6 are sectional views taken along lines A–A' and A–A' in FIG. 4, respectively.

As shown in FIGS. 5 and 6, the quick coupler 100 for an excavator according to the present invention has a cylinder tube 200 fixed to each lower end side of the excavator arm 110 and the link 120, The cylinder tube 200 fixes a piston housing 300 by fixing bolts 600, and the piston housing 300 is joined with a rod cover 310 at each end thereof. A piston 400 inserted into the piston housing 300 is restorably expanded or contracted as an advance pressure chamber 340 or an astern pressure chamber 350 is filled with hydraulic pressure by supplying the hydraulic pressure through an advance port 210 or an astern port 220 formed in separate positions, respectively. A coupler pin 500 is fitted between the cylinder tube 200 and the piston housing 300 while projecting outwardly from the cylinder tube 200 and being inserted into a joining pinhole 720 of the bucket 700. A conjugation groove 510 is formed in an inner circumference of the coupler pin 500 to engage with a conjugation ring 520 mounted on the outer circumference of an outer end of the piston 400.

The above-mentioned construction of the quick coupler will be further described in detail below.

A position guide 130 in a semicircular plate-shape is attached to upper portions of both ends of the excavator arm 110 and a lower end of the link, respectively. When the excavator arm 110 is coupled with the bucket 700, the position guide 130 is securely seated in a groove of a joining plate 710 to allow centering between the coupler pin 500 and the joining pinhole 720 and thus to facilitate the coupling.

Several fixing bolt holes 610 are formed on one side of the cylinder tube 200, and the fixing bolts 600 are inserted through the fixing bolt holes 610 to fix the piston housing 300 after the piston housing 300 is inserted into the cylinder tube 200. A pair of the pistons 400 are inserted into the piston housing 300 with a spring 420 being interposed therebetween, and are moved in opposite directions to each other along an inner circumferential portion of the piston housing 300.

With respect to this, a mechanical seal 410 is provided at each inner end of the pistons so as to prevent a friction against the inner circumferential portion of the piston housing 300 and to completely block leakage of the hydraulic fluid.

Also, the rod cover 310 is fitted in each end of the piston housing 300 to guide the movements of the piston 400, and a cover seal 320 and a rod seal 330 are provided so as to prevent the hydraulic fluid from leaking through a gap between the rod cover 310 and the piston housing 300 and a gap between the rod cover 310 and the piston 400, respectively.

The advance port 210 is provided in one position of the cylinder tube 200 to supply the hydraulic pressure to the advance pressure chamber 340 formed between the mechanical seals 410 and thus to expand the pistons 400. The astern port 220 positioned at another position of the cylinder tube 200 to form about 45 degrees with the advance port 210 supplies hydraulic pressure through a pressure line 360 to the astern pressure chambers 360 formed between the rod cover 310 and each mechanical seal 400, and, thereby, contracts the expanded pistons 400.

On the other hand, a pair of the coupler pins 500 fitted between the outer circumference of the cylinder tube 200 and the outer circumference of each outer end of the piston housing 300 are also expanded or contracted in opposite directions to each other by the movements of the pistons 300. In this regard, the present invention is characterized in that a pin seal 230 for preventing inflow of external contaminants is provided in each inlet portion of the cylinder tube 200 with which the coupler pin 500 is slidably contacted.

Figure 7:
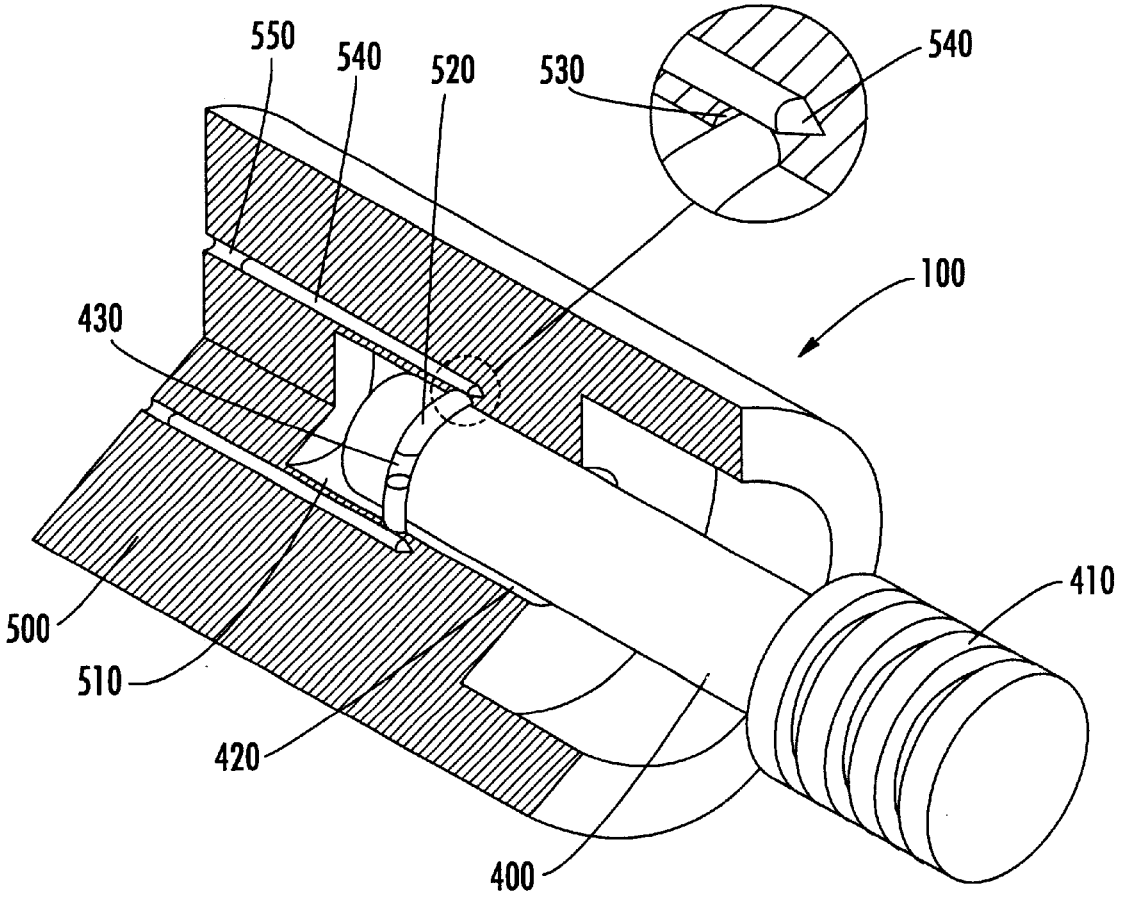
FIG. 7 is an enlarged perspective view of portion B of FIG. 6.

FIG. 7 is an enlarged perspective view of a part designated by B in FIG. 6.

As shown in FIG. 7, the conjugation groove 510 formed in each center portion of the inner surfaces of the coupler pins 500 has an inner diameter larger than an outer diameter of the piston 400 so as to permit a radial mobility of the piston 400, that is, a flexible structure of the piston 400, which is also a feature of the present invention.

Besides, a coupler pin side-ring groove 530 is circumferentially formed in an interrupted portion of the conjugation groove 510, and a piston side-ring groove 430 is circumferentially formed on an outer circumference of one end of the piston 400. The conjugation ring 520 is engaged with the piston side-ring groove 430, and has a compressive elastic force due to its partially cut-out structure when compressed.

Consequently, if the conjugation ring 520 is fitted into the piston side-ring groove 430 and then the piston 400 is pushed toward the conjugation groove 510 with the conjugation ring 520 being compressed, the conjugation ring 520 is inserted into the coupler pin side-ring groove 530 owing to enlargement of its inner diameter by the elastic force thereof.

Three tightening bolt holes 550 are formed at one end of the coupler pin 500 in such a manner that they pass over the coupler pin side-ring groove 530, and tightening bolts 540 are inserted and locked into the tightening bolt holes 550 to compress the conjugation ring 530 in the coupler pin side-ring groove 530 in an inner radial direction.

That is to say, the conjugation ring 520 is simultaneously fitted into the coupler pin side-ring groove 530 and the piston side-ring groove 430 while being subjected to the inner radial compressive force by the tightening bolts 540 and the outer radial elastic force of its own, so that a certain clearance is maintained between the ring 520 and each bottom surface of the grooves 430, 530. Since it is thus possible for the piston 400 to be moved to a certain extent within the coupler pin side-ring groove 530 and the piston side-ring groove 430, the piston 400 can be axially moved at a certain angle relative to the axial direction. The piston, therefore, has a flexible structure that the straight movement of the piston 400 is maintained even when the piston 400 is bent.

The coupler pin 500 having this movement flexibility is projected outwardly from the cylinder tube 200 and inserted into the joining pinhole 720 formed in the joining plate 710 of the bucket 700 to couple the excavator arm 110 with the bucket 700 when the piston 400 is expanded.

The operation of the so constructed quick coupler of the present invention is as follows:

If the excavator arm 110 and the link 120 are positioned in the centered position to each other by the position guide 130, the hydraulic pressure is supplied through the advance port 210 to the advance pressure chamber 340. When the piston 400 is advanced outwardly by filling the advance pressure chamber 340 with hydraulic pressure, the coupler pin 500 is also expanded and projected outwardly from the cylinder tube 200. At this time, the coupler pin 500 is inserted into the joining pinhole 720 to couple the excavator arm 110 with the bucket 700.

On the contrary, the hydraulic pressure supplied through the astern port 220 is filled in the astern pressure chamber 350 via the pressure line 360, so that the piston 400 is retracted inside the piston housing 300 while compressing the spring 420.

At this time, the coupler pin 500 engaged with the piston 400 by the conjugation ring 520 is contracted and removed from the joining pinhole 720 in accordance with the retraction of the piston 400 to release the coupling between the excavator arm 110 and the bucket 700.

Also, the conjugation ring 520 is fitted into the coupler pin side-ring groove 530 and the piston side-ring groove 430 while being pressed in the inner radial direction by the tightening bolts 540 inserted through the tightening bolt holes 550, thus leaving the above-mentioned clearance.

Accordingly, the piston 400 can be moved to a certain extent within the coupler pin side-ring groove 530 and the piston side-ring groove 430, and is given movement flexibility in which the piston 400 is allowed to be still moved straightly even when it forms an acute angle with an axial movement direction, thereby maintaining the function of the piston 300 regardless of bending of the piston 400.

As described above, the present invention provides a quick coupler 100 for an excavator, which is provided on each lower end side of an excavator arm 110 and a link 120 of the excavator in such a manner that it can facilitate mounting or detaching of an accessory to be exchanged depending on work conditions, such as a bucket, a breaker, a crusher, a vibration hammer or the like.

The quick coupler 100 for an excavator of the present invention is bilaterally symmetrical and always constant in its forward and backward movement lengths without distorting joints of the excavator, and prevents contaminants from being mixed into hydraulic working oil by a triple sealing structure of a mechanical seal 410, a cover seal 320 and a rod seal 330.

In addition, the quick coupler 100 for an excavator according to the present invention easily and simply allows centering between a joining pinhole 720 of the accessory and a coupler pin 500 by attaching a position guide 130, and the coupler pin 500 having movement flexibility has no effect on a piston 400 even when it is subjected to a perpendicular axial external force (radial force).

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A quick coupler for an excavator, the quick coupler comprising:

a cylinder tube having at least one fixing bolt hole formed on one side thereof;

a piston housing fitted into the cylinder tube to be fixed by at least one fixing bolt inserted into the at least one fixing bolt hole;

a pair of pistons inserted into each side of the piston housing and a spring interposed therebetween, each piston having a mechanical seal formed at its inner end;

a pair of rod covers inserted between an outer circumference of the pistons and an inner circumference of the piston housing on each side of the piston housing for preventing leakage of hydraulic fluid; and a pair of coupler pins inserted between an outer circumference of the piston housing and an inner circumference of the cylinder tube on each side of the cylinder tube.

2. The quick coupler according to claim 1, wherein one end of the coupler pin is formed with a predetermined number of axial tightening bolt holes that penetrate a part of a ring groove formed on the coupler pin side.

3. The quick coupler according to claim 1, wherein an inner diameter of a conjugation groove formed on an inner side of the coupler pin is larger than an outer diameter of the piston.

4. The quick coupler according to claim 1, further comprising a cover seal for preventing oil leakage in a contact portion between the rod cover and the piston housing.

5. The quick coupler according to claim 1, further comprising a rod seal for preventing oil leakage in a contact portion between the rod cover and the piston.

6. The quick coupler according to claim 1, further comprising a pin seal for preventing inflow of contaminants in an inlet portion of the cylinder tube with which the coupler pin is brought into sliding contact.

7. The quick coupler according to claim 1, further comprising an advance port mounted to penetrate the cylinder tube and the piston housing in one position to supply hydraulic pressure to an advance pressure chamber.

8. The quick coupler according to claim 1, wherein the piston housing is formed with a longitudinal pressure line that leads into an astern pressure chamber, and further comprising an astern port mounted to penetrate the cylinder tube and the piston housing in another position and connected with the longitudinal pressure line to supply hydraulic pressure to the astern pressure chamber.

9. The quick coupler according to claim 1, further comprising a position guide in a semicircular-shape to allow centering between a joining pinhole and the coupler pin.

10. The quick coupler according to claim 1, wherein each coupler pin has a cap-shape.

* * * * *